US008100481B2

(12) United States Patent
Von Schönebeck et al.

(10) Patent No.: US 8,100,481 B2
(45) Date of Patent: Jan. 24, 2012

(54) SELF-PROPELLED MACHINE FOR CUTTING OR MILLING, IN PARTICULAR A MACHINE FOR WORKING DEPOSITS BY SURFACE MINING

(75) Inventors: Winfried Von Schönebeck, Vettelschoss (DE); Gunter Hähn, Konigswinter (DE)

(73) Assignee: Wirtgen GmbH (DE)

( * ) Notice: Subject to any disclaimer, the term of this patent is extended or adjusted under 35 U.S.C. 154(b) by 578 days.

(21) Appl. No.: 12/138,116

(22) Filed: Jun. 12, 2008

(65) Prior Publication Data

US 2008/0315666 A1 Dec. 25, 2008

(30) Foreign Application Priority Data

Jun. 20, 2007 (DE) ..... 10 2007 028 812

(51) Int. Cl.
*E01C 23/088* (2006.01)

(52) U.S. Cl. ..... 299/39.6; 404/90

(58) Field of Classification Search ..... 299/39.1, 299/39.4, 39.6; 404/90, 93, 94; 180/9.5, 180/9.52; 280/6.154, 6.155, 6.157, 5.514
See application file for complete search history.

(56) References Cited

U.S. PATENT DOCUMENTS

| | | | | |
|---|---|---|---|---|
| 3,664,448 | A * | 5/1972 | Hudis | 180/9.46 |
| 3,896,989 | A * | 7/1975 | Ellis | 299/39.4 |
| 5,577,808 | A * | 11/1996 | Gilbert | 299/39.2 |
| 2008/0111327 | A1 * | 5/2008 | Rhodes et al. | 280/5.514 |
| 2010/0109422 | A1 | 5/2010 | Busley et al. | |

FOREIGN PATENT DOCUMENTS

| | | | |
|---|---|---|---|
| AU | 2006/290717 | | 3/2007 |
| DE | 10 2005 044 211 | | 3/2007 |
| DE | 102005044211 | A1 | 3/2007 |
| EP | 0744495 | A2 | 11/1996 |
| WO | WO 2007/031531 | | 3/2007 |
| WO | WO 2007031531 | A1 * | 3/2007 |

OTHER PUBLICATIONS

German Patent Office. Office Action dated Jan. 28, 2008. German Patent Application No. 10 2007 028 812.4-24. Applicant: Wirtgen GmbH. German Language. 3 pages.

German Patent Office. Office Action dated Jan. 28, 2008. German Patent Application No. 10 2007 028 812.4-24. Applicant: Wirtgen GmbH. English Language Translation. 3 pages.

Exhibit A: European Search Report in Corresponding EP 08009224 (not prior art), Dec. 2010.

Exhibit B: Wirtgen 3700 SM Brochure (admitted to be prior art).

* cited by examiner

*Primary Examiner* — Sunil Singh

(74) *Attorney, Agent, or Firm* — Waddey & Patterson, P.C.; Lucian Wayne Beavers

(57) ABSTRACT

The invention relates to a self-propelled machine for cutting or milling, which has a chassis (1), which is carried by track-laying units or wheels and which has a cutting or milling arrangement (2) and an arrangement (8) for adjusting the height of the chassis to set the depth of cutting or milling. The driver's station is decoupled from the shaking movements or vibrations from the arrangement (2) for cutting or milling which are transmitted to the chassis, and from the vibrations from the internal combustion engine for driving the machine. This decoupling is accomplished by having the height-adjusting arrangement (8) form a system which connects the track-laying units or wheels to the chassis not rigidly but in such a way that they are able to move.

41 Claims, 5 Drawing Sheets

Figure 1:
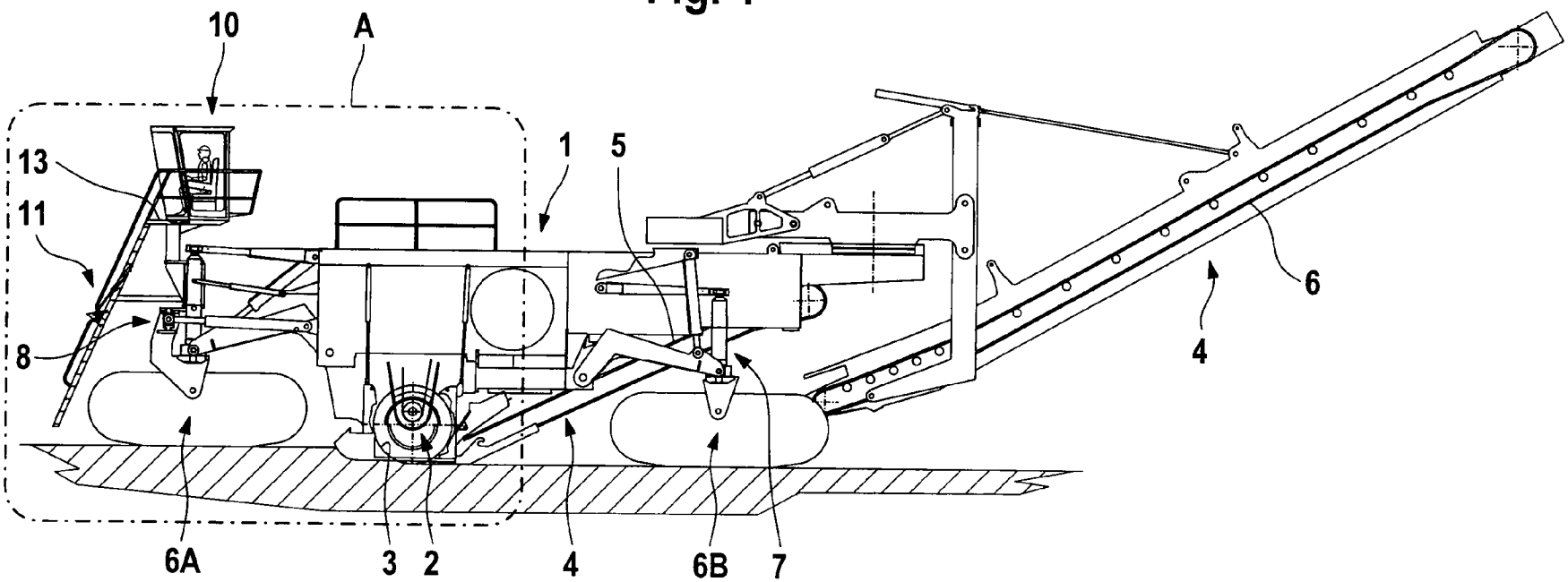

SELF-PROPELLED MACHINE FOR CUTTING OR MILLING, IN PARTICULAR A MACHINE FOR WORKING DEPOSITS BY SURFACE MINING

The invention relates to a self-propelled machine for cutting or milling, and in particular to a machine for working deposits, such as deposits of coal, ore, minerals, etc., by surface mining.

There are various kinds of self-propelled machines for cutting or milling which are known. These machines include, in particular, machines for working deposits by surface mining and civil engineering machines for road-building, such for example as road-milling machines, which can be used to remove existing layers of the surfacing structure of roads, and recyclers, which can be used to recondition existing road surfacings.

The machines for working deposits by surface mining, which are also referred to as surface miners, have an arrangement for cutting rock which has a mechanically or hydraulically driven cutting drum. Road-milling machines or recyclers have a milling arrangement which has a milling drum. The cutting or milling drums are fitted with tool holders to receive the cutting or milling tools.

While the cutting or milling arrangement is operating, shaking movements and vibrations occur in the machines for cutting or milling. Particularly when a machine for working deposits by surface mining is operating, the shaking movements and vibrations, which occur particularly when very hard granite or hard limestone is being quarried, are very severe. The person driving the machine is directly exposed to these very severe shaking movements and vibrations.

Known surface miners have an enclosed and sealed-off driver's cab which is soundproofed and which has a rotatable driver's seat. In the known surface miners, the driver's cab is fixed on the chassis, on which the cutting arrangement is also arranged. In the case of road-milling machines and recyclers too, the driver's station is fixed on the chassis.

A surface miner having a driver's cab which is fixed on the chassis is known for example from EP 0 744 495 A2 or DE 40 17 107 A1. In the surface miner known from EP 0 744 495 A2, the driver's cab is arranged at that end of the chassis of the machine which is at the front in the direction of travel, whereas in the surface miner known from DE 40 17 107 A1 the driver's station is situated in the centre of the chassis of the machine.

DE 10 2005 044 211 A1 describes a self-propelled civil engineering machine, and particular a recycler or cold-milling machine, which has a chassis which is carried by running gear which allows the height of the chassis to be adjusted. A driver's station for a person driving the vehicle is arranged on the chassis of the machine above the front wheels of the running gear. The front and rear wheels of the running gear are fixed to the chassis of the machine by means of height-adjusting arrangements, thus enabling the height of the chassis of the machine to be adjusted relative to the ground. If the height of the chassis of the machine is adjusted, there is also a change in the height of the driver's station above the ground.

The object underlying the invention is to provide a self-propelled machine for cutting or milling whose comfort and convenience when being driven is improved.

This object is achieved in accordance with the invention by virtue of the features of claim 1. Advantageous embodiments of the invention form the subject matter of the dependent claims.

The self-propelled machine for cutting or milling according to the invention is characterised in that the driver's station is not fixed on the chassis of the machine. Even though the known machines for cutting or milling have a driver's station which is arranged on the chassis of the machine, the inventors have found that if the driver's station is fixed on the chassis this leads to shaking movements or vibrations being transmitted to the driver's station when the machine is operating. The inventors have found that, to reduce the shaking movements or vibrations which are transmitted to the driver's station, it is an advantage if the driver's station is arranged to have as direct as possible a link, or in other words as direct as possible a connection, to the ground.

In the self-propelled machine according to the invention for cutting or milling, the driver's station is fixed on the arrangement for adjusting the height of the chassis. It is assumed in this case that the height-adjusting arrangements of the known self-propelled machines for cutting or milling have components which are associated with the track-laying units or wheels and which are connected to the chassis in such a way that the said components are able to move when the chassis is raised or lowered, and that they have components which are not able to move during the adjustment of height.

In the self-propelled machine according to the invention, the driver's station is fixed on a component of the height-adjusting arrangement which is connected to the chassis in such a way as to be able to move. This does not mean that the driver's station is rigidly connected to the chassis and therefore shares in the movements of the chassis but that the driver's station is mounted on a component of the height-adjusting arrangement which is connected to the chassis in such a way as to be able to move. What is meant is this case by the driver's station being fixed on a component which is connected to the chassis in such a way as to be able to move is not only its being fixed on this one component but also that the driver's station may be fixed on a plurality of components which are connected to the chassis in such a way as to be able to move. Nor, when the driver's station is said to be fixed on the movable component of the height-adjusting arrangement, does this mean that a component of the driver's station has to be connected directly to the component of the height-adjusting arrangement. Instead, to fix the driver's station in place, a component of the driver's station may also be connected to the movable component of the height-adjusting arrangement via some other component, such for example as a strut or the like.

The basic principle of the machine according to the invention for cutting or milling lies in the fact of decoupling the driver's station from the shaking movements or vibrations of the arrangement for cutting or milling which are transmitted to the driver's station or from the vibrations which are produced by the internal combustion engine for driving the machine. This decoupling is advantageously accomplished by having the height-adjusting arrangement form a system which connects the track-laying units or wheels to the chassis not rigidly but in such a way that they are able to move. The movable suspension causes the driver's station and the chassis to be decoupled from one another. What is achieved in this way is that the driver's station, like the running gear of the machine, stands, as it were, "solidly on the ground", whereas the sub-assemblies of the machine which have the cutting or milling arrangement and the internal combustion engine are carried by the running gear in such a way as to be adjustable in height relative to the ground.

The means for adjusting the components of the height-adjusting arrangement which are connected to the chassis in such a way as to be able to move advantageously cause the system to be damped. In a preferred embodiment, the means for adjusting the movable components of the height-adjusting arrangement are means able to be actuated hydraulically and/or pneumatically which preferably have a piston-and-cylinder arrangement.

Because of the elasticity of the flexible lines for actuating the piston-and-cylinder arrangement and/or the compressibility of the pressurised medium for actuating it, the piston-and-cylinder arrangement able to be actuated hydraulically and/or pneumatically acts as an element which damps the shaking movements or vibrations. It has been found that, by fixing the driver's station on the height-adjusting arrangement, the oscillations and vibrations which occur when the cutting or milling arrangement is operating, whose amplitude and frequency are absolutely indeterminate, can be effectively damped.

The fixing of the driver's station on the height-adjusting arrangement also gives the advantage that the height of the driver's station relative to the ground remains unchanged when the height of the chassis relative to the ground is changed.

A further preferred embodiment of the invention makes provision for the driver's station to be rotatable on a vertical axis. The driver's station may preferably be rotated independently of the rotary movement of the track-laying units or wheels when the machine is being steered.

The driver's station is preferably arranged above the track-laying unit or wheel and substantially above the point at which the track-laying unit is suspended to rock or the wheel is fixed to be able to turn. The person driving the machine then stands or sits exactly above the track-laying unit or wheel by which the track-laying unit or wheel stands solidly on the ground. This arrangement has proved to be optimum with regard to reducing the shaking movements or vibrations.

The driver's station which is rotatable on a vertical axis may however also be arranged next to the axis of rotation. The distance from the axis of rotation may preferably be of a size such that the driver's station can pivot out to the outer boundary of the chassis. This has the advantage that the person driving the machine can obtain a better view of the region that is being milled if the driver's station is rotated.

The driver's station preferably has a rotatable driver's seat, thus enabling the driver to change the direction in which he is looking by rotating the driver's seat, regardless of any movement of the driver's station in rotation.

Because the driver's station maintains its height above the ground, the driver's station can be climbed into from a ladder of the same length in any of the working positions. The ladder for climbing into the driver's station is preferably a ladder which can be unfolded.

The driver's station is preferably in the form of a driver's cab which protects the driver from falling fragments, dust and dirt and also noise.

In a further preferred embodiment, the driver's station is arranged on what is termed the drive side of the machine, on which the drive unit for the cutting or milling arrangement is also arranged. On what is called the non-drive side of the machine, which is the opposite side from the drive side, the end-face of the cutting or milling drum then extends to a point close to the outside of the chassis, whereas on the drive side the end face of the cutting or milling drum is set back from the outer boundary of the chassis of the machine for a relatively long distance. Hence, to achieve a steep angle of inclination, the non-drive side of the machine is used to mill along the inclination. The fact that the driver's station is arranged on the drive side is then of advantage in that the person driving the machine cannot be endangered by stones coming from the inclination. If however there is no risk of being hit by stones, it may also be advantageous for the driver's station to be arranged on the non-drive side, because the person driving the machine then has a better view of the region which is being milled. Provision may therefore be made, in a preferred embodiment of the machine, to enable the driver's station to be arranged on either the drive side or the non-drive side of the machine without the need for any extensive conversion work.

In a particularly preferred embodiment of the invention, provision is made for the height-adjusting arrangement to have parallelogram mountings associated with the individual track-laying units or wheels. The parallelogram mountings preferably each have an upper and a lower component which are each hingeably connected to the chassis at one end, and a component which is hingeably connected to the other ends of the upper and lower components and from which the track-laying unit or wheel is suspended. In this particularly preferred embodiment, the driver's station is fixed on the component which is hingeably connected to the upper and lower components of the parallelogram mounting. This component maintains its position relative to the ground when the chassis is raised or lowered. The position of the driver's station therefore remains unchanged too when the chassis is raised or lowered.

The component which hingeably connects the upper and lower components of the parallelogram mounting may take different forms. Preferably, the said component takes the form of a cylindrical component, such as a pillar for example.

The driver's station is preferably carried by a fixing arrangement which encloses the cylindrical component in such a way as to be rotatable on a vertical axis. The driver's station is preferably arranged above the cylindrical component so that the person driving the machine can see the track-laying units or wheels to allow him to check the steering movements.

The fact of the driver's station being fixed on the height-adjusting arrangement also proves to be advantageous in that the driver's station can be arranged at a relatively low point but when so arranged always remains above the height-adjusting arrangement. This gives a better view to the side, thus enabling the person driving the vehicle to watch the unloading of the material which has been cut or milled away.

An arrangement for adjusting the height of the chassis which takes the form of a parallelogram mounting is of particular advantage when the machine according to the invention for cutting or milling is a machine for working deposits by surface mining (a surface miner). When however the machine according to the invention is a road-milling machine or recycler, the arrangement for adjusting the height of the chassis advantageously takes the form of a straight-line mounting having two components able to be displaced relative to one another of which one component is connected to the chassis and from the other of which components the track-laying unit or wheel is suspended. The driver's station is connected in this embodiment to that component of the straight-line mounting from which the running gear is suspended. In this embodiment, the components which are displaceable relative to one another preferably have an outer hollow cylinder which is connected to the chassis and in which an inner hollow cylinder is guided to be longitudinally displaceable. To allow the chassis to be raised or lowered, a piston-and-cylinder arrangement, which can be actuated hydraulically or pneumatically, is preferably arranged in the inner hollow cylinder. The piston-and-cylinder arrangement once again constitutes a damping element to allow shaking movements or vibrations to be kept away from the driver's station.

Figure 2:
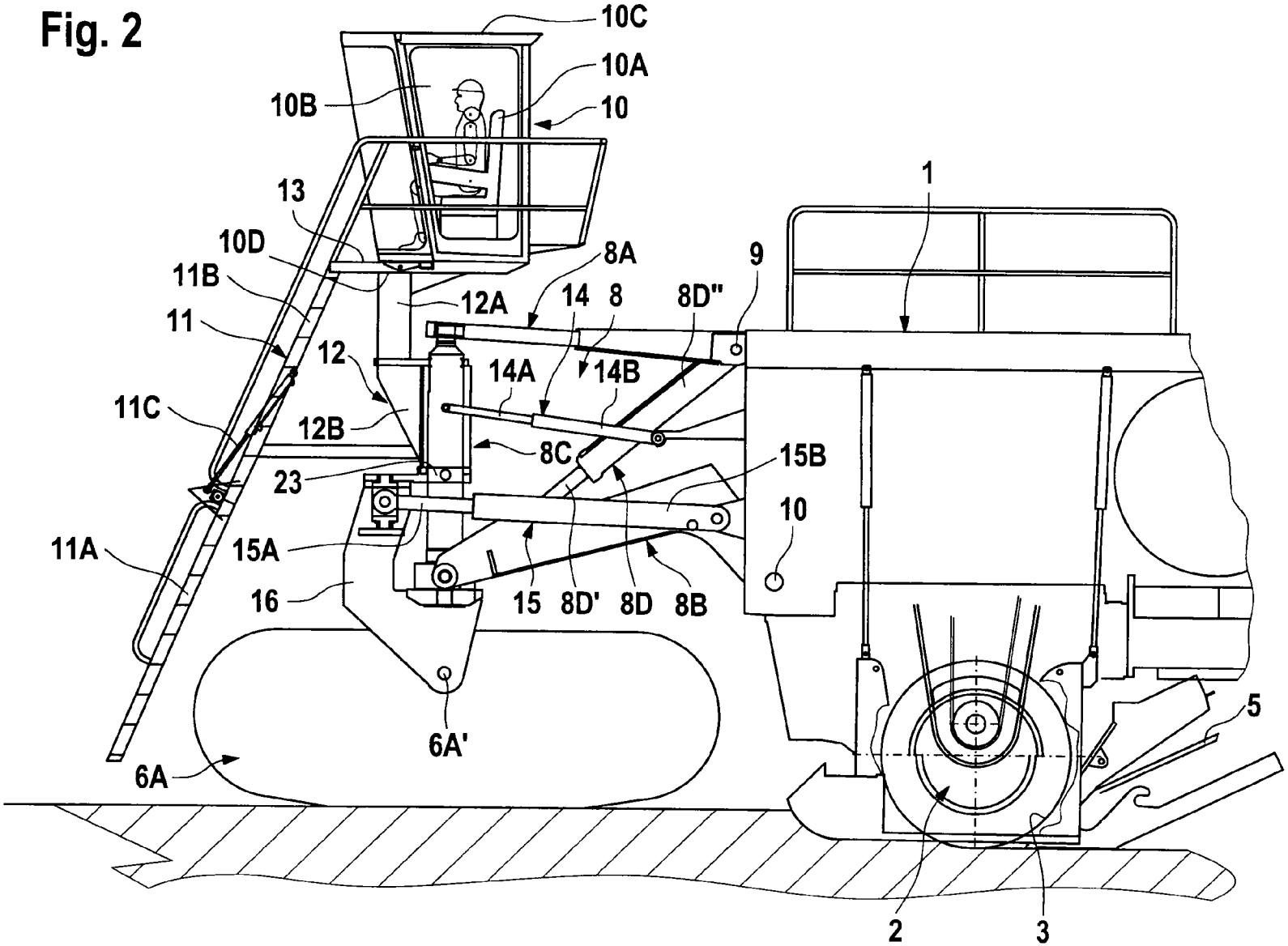
Figure 3:
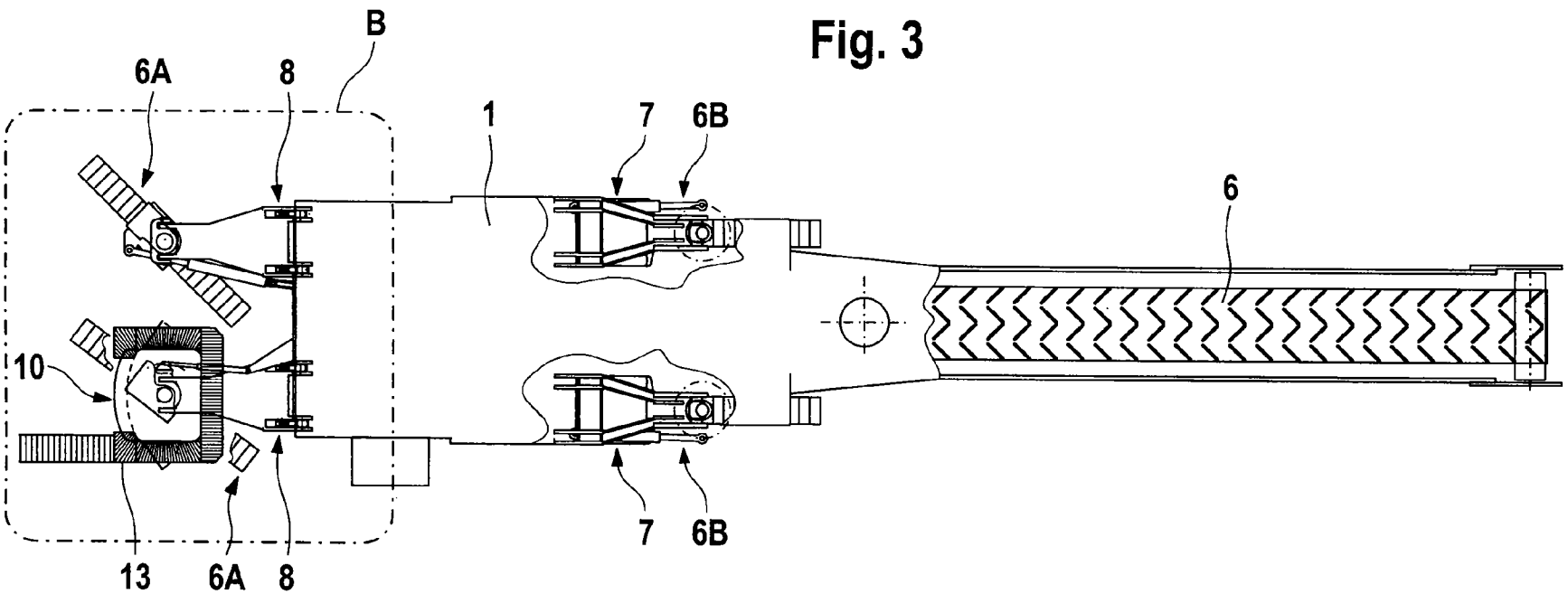
Figure 4:
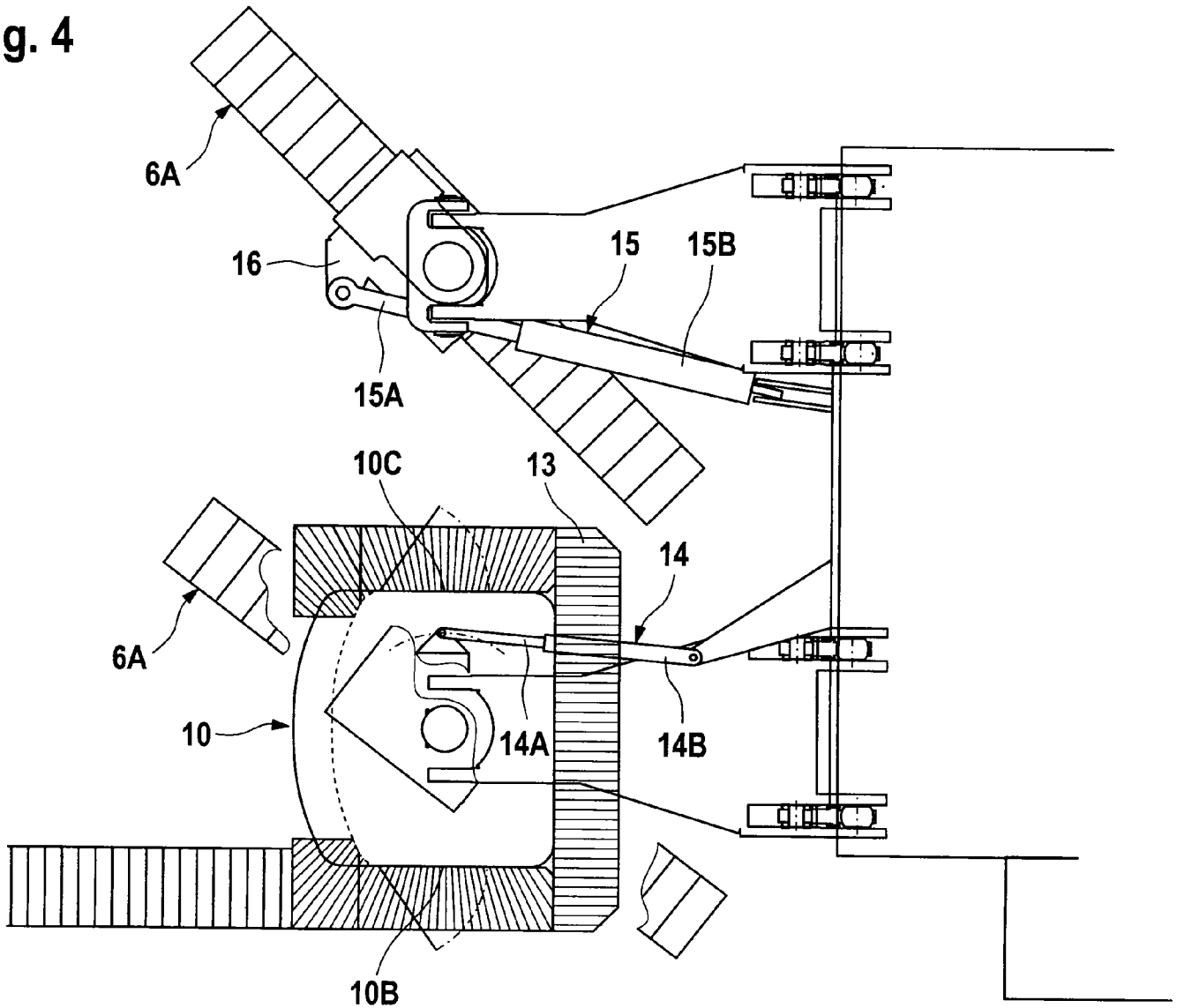
Figure 5:
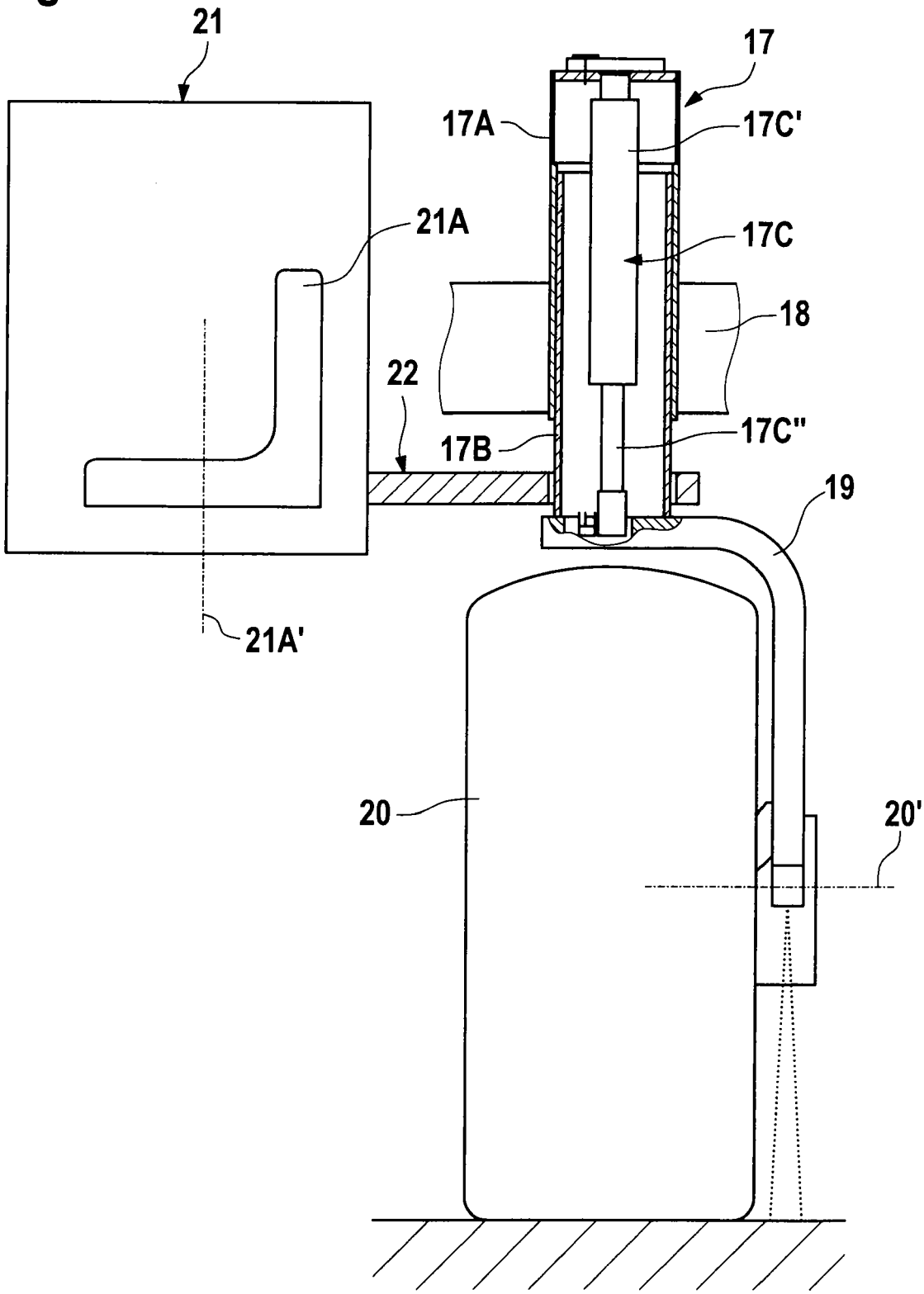

Embodiments of the invention will be explained in detail below by reference to the drawings. In the drawings:

FIG. 1 is a view from the side of a machine for working deposits by surface mining, FIG. 2 is an enlarged view from the side of detail A of FIG. 1, showing the driver's station of the machine shown in FIG. 1, FIG. 3 is a plan view of the machine of FIG. 1, FIG. 4 is an enlarged plan view of detail B of FIG. 3, showing the driver's station and FIG. 5 is a simplified schematic view of a further embodiment of the arrangement of the driver's station on a civil engineering machine.

FIGS. 1 and 3 are views from the side and in plan of a machine for working deposits by surface mining which will be referred to in what follows as a surface miner. The surface miner for cutting rock has a chassis 1 which takes the form of a welded structure which is stiff in bending. Arranged on the chassis 1 is a cutting arrangement 2 having a cutting drum 3 which is provided with tool holders (not shown) to receive the cutting tools (not shown). The drive unit (not shown) having the internal combustion engine for driving the machine is situated in the chassis 1. The mechanical transmission for transmitting force from the internal combustion engine to the cutting or milling drum is situated on what is termed the drive side of the machine which, in the present embodiment, is that side of the machine which is on the left in the direction of travel. On what is termed the non-drive side of the machine, which is the opposite side from the drive side, the end-face of the cutting or milling drum then extends to a point close to the outer side of the chassis, whereas on the drive side the end-face of the cutting or milling drum is set a relatively long distance back from the outer boundary of the chassis of the machine.

The material which is cut and comminuted by the cutting drum 3 is picked up by a loading means 4 which comprises a wide pick-up belt downstream of the cutting drum 3 in the direction of travel and a succeeding discharge belt 6 for unloading onto transport vehicles. The height of the discharge belt 6 can be adjusted and it can be pivoted to both sides.

The chassis 1 can be moved on two front and two rear track-laying units 6A and 6B which are arranged at the front and rear ends of the chassis 1, and the depth of cut is adjusted by raising or lowering the said chassis.

The arrangement for adjusting the height of the chassis 1 has parallelogram mountings which are associated with the individual track-laying units 6A, 6B and of which those parallelogram mountings which are arranged at the rear end of the chassis are identified by reference numeral 7 and those parallelogram mountings which are arranged at the front end of the chassis are identified by reference numeral 8. The four track-laying units 6A, 6B are suspended on the parallelogram mountings 7, 8 to rock thereon, the track-laying units being able to be moved in relation to the chassis in a vertical plane. However, because the track-laying units stand on the ground, it is the chassis 1 which is raised or lowered relative to the ground.

The individual components of that parallelogram mounting 8 which is arranged at the front end of the chassis and which is associated with that track-laying unit 6A which is on the left in the direction of travel are shown enlarged in FIG. 2. The front left-hand parallelogram mounting 8 for suspending the front left-hand track-laying unit 6A in such a way as to rock has a top link 8A and a bottom link 8B which are each hingeably connected to the chassis 1 at one end, thus enabling the top and bottom links 8A, 8B to pivot on respective horizontal axes 9, 10. The other ends of the two links 8A, 8B are connected to the top and bottom ends of a vertical pillar 8C. This being the case, the two links 8A, 8B and the pillar 8C form a parallelogram, with the pillar 8C being able to be moved up and down in a vertical plane.

To allow the pillar 8C to be raised or lowered, the parallelogram mounting 8 has a piston-and-cylinder arrangement 8D, with one end of the piston 8D' of the piston-and-cylinder arrangement 8D being hingeably connected to the bottom end of the pillar 8C and one end of the cylinder 8D" thereof being hingeably connected to the chassis 1. By retracting and extending the piston of the piston-and-cylinder arrangement, the pillar 8C of the parallelogram mounting 8 is respectively raised and lowered if the running gear is not standing on the ground. However, because the running gear is standing on the ground, it is the chassis which is raised or lowered if the piston-and-cylinder arrangement 8D is actuated, thus changing the depth of cut.

The surface miner has a driver's station 10 which is in the form of an enclosed, soundproofed driver's cab. Situated in the driver's cab 10 is a rotatable driver's seat 10A for the person driving the machine. The driver's cab 10 is glazed all round, thus given the person driving the machine a view in all directions. It has left-hand and right-hand driver's doors 10B, 10C. The person driving the machine is able to reach the driver's cab 10 by means of a ladder 11 whose length can be adjusted. The ladder 11 comprises bottom and top portions 11A, 11B which are hingeably connected to one another. The ladder can be folded upwards with a piston-and-cylinder arrangement 11C.

The driver's cab 10 is so arranged that its centre of gravity is situated above the track-laying unit or wheel and substantially above the pillar 8C of the parallelogram mounting 8, the driver's seat 10A too being situated above the pillar. It is accessible to the person driving the machine from both sides by means of a walkway 13 which extends round it.

In what follows, the way of fixing the drivers' cab 10 on the arrangement for adjusting the height of the chassis, which is what distinguishes the surface miner according to the invention, will be described in detail.

The parallelogram mounting 8 has components which are movable relative to the chassis 1 and these include the top and bottom links 8A and 8B and the pillar 8C and, basically, the piston-and-cylinder arrangement 8D too. The driver's cab 10 is fixed, on one of the components of the parallelogram mounting 8 which are hingeably connected to the chassis 1, to be rotatable on a vertical axis.

In the present embodiment, the chassis is fixed on the pillar 8C of the parallelogram mounting 8 to be rotatable on a vertical axis. Because the running-gear unit 6A stands on the ground, the position of the driver's cab relative to the ground remains unchanged if the piston-and-cylinder arrangement 8D of the parallelogram mounting 8 is actuated.

Fixing the driver's cab 10 on the pillar 8C of the parallelogram mounting 8 has the crucial advantage that the driver's cab is decoupled from the chassis 1. Because of this decoupling, shaking movements or vibrations which occur when the cutting drum 3 and the internal combustion engine are running to operate the machine are not transmitted directly to the driver's cab. In this case, the piston-and-cylinder arrangement 8D of the parallelogram mounting 8 constitutes a damping element which reduces the shaking movements or vibrations. Basically, it is equally possible for the driver's cab to be fixed on some other movable component of the parallelogram mounting such for example as on the top or bottom link 8A, 8B. However, fixing it in this way has proved to be more costly and complicated structurally because these components change their position relative to the ground when the piston-and-cylinder arrangement 8D is actuated.

The driver's cab 10 is carried by a fixing arrangement 12 which has a vertical pillar 12A fixed to a base-plate 10D of the driver's cab and a bracket 12B which is connected to a plain bearing 23 which is mounted on the pillar 8C of the parallelogram mounting 8. The driver's seat 10A in the driver's cab 10 is mounted above the parallelogram mounting 8, on the axis of the pillar 8C, in this case. Because the person driving the machine is not situated in front of the pillar 8C in the direction of travel but directly above it, he is able to see the front track-laying units 6A to allow him to check the steering movements.

To allow the cab to be turned about the pillar 8C of the parallelogram mounting 8, a piston-and-cylinder arrangement 14 is provided whose piston 14A is hingeably connected to the bracket 12B of the arrangement 12 for fixing the driver's cab 10 and whose cylinder 14B is hingeably connected to the chassis 1. When the piston 14A of the piston-and-cylinder arrangement 14 is retracted or extended, the driver's cab 10 turns on a vertical axis regardless of the position of the track-laying unit 6A.

To steer the surface miner, the front track-laying units 6A are turned on a vertical axis. Each track-laying unit is provided for this purpose with a further piston-and-cylinder arrangement 15 whose piston 15A is hingeably connected to a bracket 16 belonging to the running-gear suspension, from which the running-gear unit 6A is suspended to rock on a horizontal axis 6A'. The bracket 16 of the running-gear suspension is fixed in turn to the pillar 8C of the parallelogram mounting 8, the pillar 8C being fixed to respective ends of the top and bottom links 8A and 8B in such a way as to be rotatable on a vertical axis.

The driver's cab 10, which is arranged above the pillar 8C of the parallelogram mounting 8, is situated substantially above the horizontal axis 6A' on which the running-gear unit 6A is suspended to rock.

In what follows, an alternative embodiment of the arrangement of the driver's cab will be described by reference to FIG. 5, which is a schematic view showing the principal components of the running-gear suspension of a civil engineering machine and in particular a road-milling machine or recycler. Basically, the road-milling machine or recycler differs from the surface miner in that, instead of a cutting arrangement having a cutting drum, what is provided is a milling arrangement (not shown) having a milling drum. However, the milling arrangement having the milling drum also produces shaking movements or vibrations when operating, to which the person driving the machine ought not to be exposed. Added to these there are also, once again, the vibrations from the internal combustion engine used to drive the machine. The suspension of the running gear of the road-milling machine or recycler differs from the running-gear suspension of the surface miner in that a straight-line mounting is provided rather than a parallelogram mounting.

The straight-line mounting 17 of the road-milling machine has an outer hollow cylinder 17A which is fixed on the chassis 18 of the road-milling machine. FIG. 5 shows only one of the total of four straight-line mountings 17 which the road-milling machine has. The straight-line mounting in question is the straight-line mounting on the drive side of the machine, which is on the left in the direction of travel.

Arranged to be longitudinally displaceable in the outer hollow cylinder 17A of the straight-line mounting 17 is an inner hollow cylinder 17B whose bottom end is connected to a strut 19 to which a wheel 20 which is able to turn on a horizontal axis 20' is fixed or from which a track-laying unit able to pivot on the axis 20' may equally well be suspended.

Situated inside the inner hollow cylinder 17B is a piston-and-cylinder arrangement 17C whose piston 17C' is fixed to the chassis 18 and whose cylinder 17C" is connected to the strut 19. By actuating the piston-and-cylinder arrangement 17C, the outer and inner cylinders 17A, 17B are displaced relative to one another and the height of the chassis 18 is thus adjusted relative to the ground.

The civil engineering machine whose running-gear suspension is shown in FIG. 5 is described in detail in DE 10 2005 044 211 A1, the disclosure of which is hereby incorporated by reference.

In the civil engineering machine shown in FIG. 5, which has a straight-line mounting 17 rather than a parallelogram mounting for the individual wheels, the driver's station 21, which is only shown schematically and which is in the form of an enclosed driver's cab having a driver's seat able to be rotated on the axis 21A', is once again fixed on a component of the mounting which is movable relative to the chassis, this component being, in the present case, the inner hollow cylinder 17B of the piston-and-cylinder arrangement 17. In this case the fixing is not directly on the inner hollow cylinder 17B but on a fixing arrangement 22 by which the driver's cab is mounted to be pivotable on the hollow cylinder on a vertical axis. Since FIG. 5 is only a purely schematic view, for greater clarity the driver's cab is arranged next to the straight-line mounting in a way in which it would not be if the view were true to scale. However, it goes without saying that the driver's cab may be connected to the straight-line mounting with a fixing arrangement of a suitable form in such a way, or the fixing arrangement may be so formed, that the driver's cab is situated in a suitable position above the wheel, and in particular substantially above the axis 20' of the wheel 20.

Because the driver's cab 21 is not connected directly to the chassis 18 but is decoupled from the chassis by means of the straight-line mounting 17, shaking movements or vibrations which occur when the milling drum and the internal combustion engine are operating are suppressed. In this case too the piston-and-cylinder arrangement 17C of the straight-line mounting 17 forms, once again, a damping element. Here too, the fact of the driver's station being fixed on the height-adjusting arrangement once again produces the advantage that the height of the driver's station relative to the ground remains unchanged when the height of the chassis relative to the ground is changed.

The invention claimed is:

1. A self-propelled machine for cutting or milling, comprising:

a chassis;

a cutting or milling arrangement arranged on the chassis;

a running gear arranged on the chassis and including track-laying units or wheels;

a height adjusting arrangement for adjusting a height of the chassis relative to the running gear, the height adjusting arrangement including a parallelogram mounting including:

an upper component having a first end hingeably connected to the chassis, and having a second end;

a lower component having a first end hingeably connected to the chassis and having a second end; and a cylindrical third component hingeably connected to the second ends of the upper and lower components, one of the track laying units or wheels being suspended from the third component;

the upper and lower components and the third component being movable relative to the chassis to adjust the height of the chassis relative to the running gear; and a driver's station including a support bracket rotatably mounted on the cylindrical third component so that the driver's station is rotatable about a vertical axis relative to the cylindrical third component.

2. The self-propelled machine of claim 1, wherein:

the driver's station is arranged on the support bracket substantially above the cylindrical third component.

3. The self-propelled machine of claim 1, further comprising:

a piston and cylinder connected between the chassis and the support bracket for rotating the support bracket and the driver's station about the vertical axis relative to the cylindrical third component.

4. A self-propelled machine for cutting or milling, comprising:

a chassis;

a cutting or milling drum supported from the chassis;

a running gear including two front track-laying units and two rear track-laying units for supporting the chassis from a ground surface;

an internal combustion engine mounted on the chassis for powering at least the running gear;

four height adjustment assemblies connected between the chassis and the front and rear track-laying units, each height adjustment assembly including a moveable component that moves relative to the chassis but has a fixed height relative to the ground surface when the height of the chassis relative to the ground surface is adjusted; and an enclosed driver's cab mounted on the moveable component of one of the height adjustment assemblies and located so that at least part of the enclosed driver's cab is located directly above the track-laying unit connected to the one height adjustment assembly.

5. The self-propelled machine of claim 4, wherein:

the track-laying unit connected to the one height adjustment assembly on which the enclosed driver's cab is mounted is connected to the one height adjustment assembly at a rotational connection defining a horizontal rotational axis from which the track-laying unit is suspended to rock; and at least part of the enclosed driver's cab is located directly above the rotational connection.

6. The self-propelled machine of claim 4, wherein:

the moveable component of the height adjustment assembly on which the enclosed driver's cab is mounted comprises a substantially vertical cylindrical component having a vertical axis; and the enclosed driver's cab includes a driver's seat located substantially above the vertical axis of the cylindrical component.

7. The self-propelled machine of claim 4, wherein:

the enclosed driver's cab has a center of gravity located substantially above part of the track-laying unit connected to the one height adjustment assembly on which the enclosed driver's cab is mounted.

8. The self-propelled machine of claim 4, wherein:

each height adjustment assembly includes a hydraulic or pneumatic height adjuster.

9. The self-propelled machine of claim 8, wherein:

each hydraulic or pneumatic height adjuster comprises a piston and cylinder unit.

10. The self-propelled machine of claim 4, wherein:

the enclosed driver's cab is rotatable on a vertical axis.

11. The self-propelled machine of claim 4, wherein:

the enclosed driver's cab is moveably mounted on the moveable component so that the enclosed driver's cab is laterally moveable relative to the moveable component.

12. The self-propelled machine of claim 4, wherein:

the enclosed driver's cab is arranged on a drive side of the self-propelled machine.

13. The self-propelled machine of claim 4, wherein:

the enclosed driver's cab includes a rotatable driver's seat.

14. The self-propelled machine of claim 4, further comprising:

an adjustable length ladder attached to the enclosed driver's cab.

15. The self-propelled machine of claim 4, wherein:

the height adjustment assembly on which the enclosed driver's cab is mounted includes a parallelogram mounting including:

an upper component having a first end pivotally connected to the chassis and having a second end;

a lower component having a first end pivotally connected to the chassis and having a second end; and the moveable component being pivotally connected to the second ends of the upper and lower components.

16. The self-propelled machine of claim 15, wherein:

the enclosed driver's cab includes a support bracket connected to the moveable component.

17. The self-propelled machine of claim 4, wherein:

the height adjustment assembly on which the enclosed driver's cab is mounted has a straight-line mounting having two components able to be displaced relative to one another, one of the two components being connected to the chassis and the other of the two components being the moveable component on which the enclosed driver's cab is mounted.

18. The self-propelled machine of claim 17, wherein:

the one of the two components is an outer hollow cylinder connected to the chassis, and the moveable component is an inner hollow cylinder received in and longitudinally displaceable relative to the outer hollow cylinder.

19. The self-propelled machine of claim 18, further comprising:

a piston and cylinder located inside the inner hollow cylinder to raise or lower the inner hollow cylinder to allow the height of the chassis relative to the ground surface to be adjusted.

20. A self-propelled surface miner machine, comprising:

a chassis;

a cutting drum supported from the chassis;

front and rear track-laying units supporting the chassis from a ground surface;

an internal combustion engine mounted on the chassis for powering at least the track-laying units;

a height adjustment assembly connected between the chassis and one of the track-laying units for adjusting a depth of cut of the cutting drum into the ground surface, the height adjustment assembly including a moveable component that moves relative to the chassis, but has a fixed height relative to the ground surface, when the height of the chassis relative to the ground surface is adjusted; and an enclosed driver's cab entirely mounted on the moveable component of the height adjustment assembly so that all parts of the driver's cab remain fixed in height relative to the ground surface when the height of the chassis relative to the ground surface is adjusted to adjust the depth of cut of the cutting drum.

21. The machine of claim 20, wherein:

the height adjustment assembly is hydraulically and/or pneumatically actuatable.

22. The machine of claim 21, wherein:

the height adjustment assembly includes a piston-and-cylinder arrangement.

23. The machine of claim 20, wherein:

the enclosed driver's cab is arranged above the one of the track-laying units substantially above a point from which the one of the track-laying units is suspended to rock.

24. The machine of claim 20, wherein:

the enclosed driver's cab is rotatable on a vertical axis.

25. The machine of claim 20, wherein:

the enclosed driver's cab is moveably mounted on the moveable component so that the enclosed driver's cab is laterally moveable relative to the moveable component.

26. The machine of claim 20, wherein the enclosed driver's cab is arranged on a drive side of the self-propelled machine.

27. The machine of claim 20, wherein:

the enclosed driver's cab includes a rotatable driver's seat.

28. The machine of claim 20, further comprising:

an adjustable length ladder attached to the enclosed driver's cab.

29. The machine of claim 20, wherein:

the height adjustment assembly includes a parallelogram mounting including:

an upper component having a first end pivotally connected to the chassis and having a second end;

a lower component having a first end pivotally connected to the chassis and having a second end; and the moveable component being pivotally connected to the second ends of the upper and lower components.

30. The machine of claim 29, wherein:

the enclosed driver's cab includes a support bracket connected to the moveable component.

31. The machine of claim 20, wherein:

the height adjustment assembly has a straight-line mounting having two components able to be displaced relative to one another, one of the two components being connected to the chassis and the other of the two components being the moveable component on which the enclosed driver's cab is mounted.

32. The machine of claim 31, wherein:

the one of the two components is an outer hollow cylinder connected to the chassis, and the moveable component is an inner hollow cylinder received in and longitudinally displaceable relative to the outer hollow cylinder.

33. The machine of claim 32, further comprising:

a piston and cylinder located inside the inner hollow cylinder to raise or lower the inner hollow cylinder to allow the height of the chassis relative to the track-laying unit to be adjusted.

34. A self-propelled machine for cutting or milling, comprising:

a chassis;

a cutting or milling drum supported from the chassis;

a running gear including front and rear track-laying units for supporting the chassis from a ground surface;

an internal combustion engine mounted on the chassis for powering at least the running gear;

a height adjustment assembly connected between the chassis and a front one of the track-laying units, the height adjustment assembly including a moveable component that moves relative to the chassis but has a fixed height relative to the ground surface when the height of the chassis relative to the ground surface is adjusted; and an enclosed driver's cab mounted on the moveable component of the height adjustment assembly and located forward of the chassis in the direction of travel.

35. The machine of claim 34, wherein:

the height adjustment assembly includes a parallelogram mounting including:

an upper component having a first end pivotally connected to the chassis and having a second end;

a lower component having a first end pivotally connected to the chassis and having a second end; and the moveable component being pivotally connected to the second ends of the upper and lower components.

36. The machine of claim 34, wherein:

the height adjustment assembly has a straight-line mounting having two components able to be displaced relative to one another, one of the two components being connected to the chassis and the other of the two components being the moveable component on which the enclosed driver's cab is mounted.

37. The machine of claim 34, wherein:

the enclosed driver's cab is arranged above the front one of the track-laying units substantially above a point from which the front one of the track-laying units is suspended to rock.

38. The machine of claim 34, wherein:

the enclosed driver's cab is rotatable on a vertical axis.

39. The machine of claim 34, wherein:

the enclosed driver's cab is moveably mounted on the moveable component so that the enclosed driver's cab is laterally moveable relative to the moveable component.

40. The machine of claim 34, wherein the enclosed driver's cab is arranged on a drive side of the self-propelled machine.

41. The machine of claim 34, wherein:

the enclosed driver's cab includes a rotatable driver's seat.

* * * * *